US008800100B2

(12) United States Patent
Bradley

(10) Patent No.: US 8,800,100 B2
(45) Date of Patent: Aug. 12, 2014

(54) TOYDOZER SCOOP AND GATHERER SET

(76) Inventor: Amy Bradley, Wyndmoor, PA (US)

( * ) Notice: Subject to any disclaimer, the term of this patent is extended or adjusted under 35 U.S.C. 154(b) by 326 days.

(21) Appl. No.: 13/301,349

(22) Filed: Nov. 21, 2011

(65) Prior Publication Data

US 2013/0125334 A1 May 23, 2013

(51) Int. Cl.
*A47L 13/52* (2006.01)

(52) U.S. Cl.
CPC ..... *A47L 13/52* (2013.01)
USPC ..... 15/257.1; 15/105

(58) Field of Classification Search
CPC ..... A47L 13/52; E01H 1/1206
USPC ..... 15/257.1, 257.2, 105
See application file for complete search history.

(56) References Cited

U.S. PATENT DOCUMENTS

| | | | | | |
|---|---|---|---|---|---|
| D180,209 | S | * | 4/1957 | Tupper | D32/74 |
| 3,408,681 | A | * | 11/1968 | Isakson | 15/257.2 |
| 3,469,274 | A | * | 9/1969 | Snapp | 15/228 |
| 3,534,424 | A | * | 10/1970 | Levinson | 15/105 |
| 3,639,937 | A | * | 2/1972 | Sweeney | 15/104.8 |
| D267,592 | S | | 1/1983 | Payne, Jr. et al. | |
| 5,588,174 | A | * | 12/1996 | Godfrey | 15/257.2 |
| 5,887,919 | A | * | 3/1999 | Sallinen et al. | 294/54.5 |
| 5,924,162 | A | | 7/1999 | Kalsheur et al. | |
| D422,389 | S | | 4/2000 | Gay | |
| D458,091 | S | | 6/2002 | Wallays et al. | |
| D463,643 | S | | 9/2002 | Petner | |
| 6,685,529 | B1 | | 2/2004 | Sarabia | |
| 6,733,056 | B2 | * | 5/2004 | Daniele | 294/212 |
| 7,037,165 | B2 | | 5/2006 | Garr | |
| 7,866,720 | B2 | * | 1/2011 | Haws et al. | 294/58 |
| D645,310 | S | | 9/2011 | Shamoon | |
| 8,555,459 | B2 | * | 10/2013 | Ward et al. | 15/257.1 |
| 2005/0165494 | A1 | | 7/2005 | McLeod et al. | |
| 2007/0049157 | A1 | | 3/2007 | Bolar | |

* cited by examiner

*Primary Examiner* — Shay Karls
(74) *Attorney, Agent, or Firm* — St. Onge Steward Johnson & Reens LLC

(57) ABSTRACT

A scoop and gatherer set for picking up small items and debris, such as for use by a child to scoop-up small toys. The scoop comprises a trapezoidal bottom, two triangular side walls, and a rectangular back wall. The back wall also comprises a rectangular hole of sufficient size to insert a user's palm to grasp and lift the scoop without extensive rotation of a user's wrist. The gatherer is of a slightly concave trapezoidal shape comprising a ledge on the top edge inner surface to assist in grasping it. The gatherer bottom edge may further comprise short bristles for brushing items into the scoop, or a smooth fabric to prevent scratching of the floor surface. The set may further comprise a means to quickly attach and detach the gatherer to the scoop for storage as one unit.

20 Claims, 9 Drawing Sheets

TOYDOZER SCOOP AND GATHERER SET

FIELD OF INVENTION

The present invention relates generally to a cleaning tool and particularly to a two part device for use by children and adults to scoop-up small items.

BACKGROUND OF THE INVENTION

There are thousands of products to assist a user in cleaning up a surface area, including brooms, dustpans, scrapers, mops, etc.... These devices are geared, though, to adult users, and not to children who possess less manual dexterity and smaller hands. Traditional cleaning devices usually require the user to grasp a cylindrical, stick handle which places the weight and control of the device primarily on the user's fingers and wrist. This may prove difficult for children, and for users with a medical condition that inhibits the closing of their palms or the rotation of their wrist, such as arthritic patients.

There is a need within the industry for a device to assist people in picking up small items quickly, especially children picking up small toys, and individuals who have difficultly using their hands and/or wrists.

SUMMARY

The present invention comprises a device consisting of two parts: 1) a scoop to collect small objects; and 2) a gatherer to push or brush them into the scoop. The gatherer may further comprise small bristles from about 0.5 to about 1 inch in length extending from the end of the gatherer for use in brushing small items into the scoop. The scoop and gatherer set may also be manufactured in a variety of sizes and materials to suit the intended use and user, such as small version for cleaning up nails and bolts by a carpenter versus cleaning up small toys by a child. For example, for a carpenter to pick up nails and bolts, the scoop may comprise the dimensions of about 6 inches*6 inches*4 inches for the scoop, and 5 inches*⅛ inch*5 inches for the gatherer; while a child's version to pick-up toys would be about 10 inches*8 inches*4 inches in dimensions.

The scoop comprises: 1) a bottom with a means to attach the gatherer to the upper surface of said bottom; 2) two side walls extending from the top of the back wall to the front of the bottom side; 3) a back wall and comprising a means for grasping the scoop that does not require the use of a handle, and wherein the bottom is adjoined to the side and back walls with seamless, curved edges. The bottom, side and back walls may comprise a variety of shapes, such as rectangular or trapezoidal, and flat or concave inward. In a preferred embodiment, the bottom is flat, trapezoidal in shape; the side walls are triangular with an arced or curved top edge extending from the top of the back wall to the front edge of the bottom; and the back wall is rectangular. The scoop further comprises the back and side walls be connected to the bottom with seamless, curved edges to prevent debris from collecting into cracks. The back wall may also reside at less than a right angle to the bottom to assist in preventing the contents of the scoop from falling out when held by the user.

The multiple methods of use of the present invention are obvious to one of ordinary skill in the art. In a preferred method of use, means for grasping the scoop comprises a rectangular hole within the back wall of sufficient length to comfortably fit a user's index, long, ring, and small finger. The user may place their thumb onto the scoop's back wall ledge, or over the ledge and onto the scoop's back wall inner surface. Alternatively, the user may place their user's index, long, ring, and small finger underneath the scoop's bottom wall surface. In either method, the scoop is primarily secured by the fingers with minimal wrist rotation.

The top ledge of the scoop may further comprise a tactile surface. The tactile surface may comprise a material, such as a rubber composite, and a texture, such as parallel ridge lines. The material and shape of the surface prevent slippage of the user's thumb.

The gatherer primarily comprises an essentially flat apparatus small enough to be stored within the scoop with the gatherer's underside attached to the scoop's bottom. The gatherer comprises a bottom edge engaged in pushing or placing objects or debris into the scoop, and a top edge that is held by the user. To assist the user in clasping the gatherer, the top edge may further comprise various shapes, such as a ledge on the gatherer underside for placement of the user's thumb. In a preferred embodiment, the gatherer is of a slightly concave trapezoid shape, wherein the top edge is parallel to and shorter than the bottom edge. The gatherer may additionally comprise small bristles extending from the bottom edge to sweep small items and debris into the scoop, or a smooth material, such as a felt-like strip, along the bottom edge to prevent scraping of a floor surface.

The gatherer further comprises a means for easily affixing it to the upper surface of the scoop bottom and storing the set as one unit. In a preferred embodiment of the present invention, two strips of hook and loop fasteners (e.g. Velcro®) attach the gatherer to the scoop bottom's upper surface.

BRIEF DESCRIPTION OF THE DRAWINGS

In the accompanying drawings, which illustrate an exemplary embodiment of the present invention.

DETAILED DESCRIPTION

Figure 1:
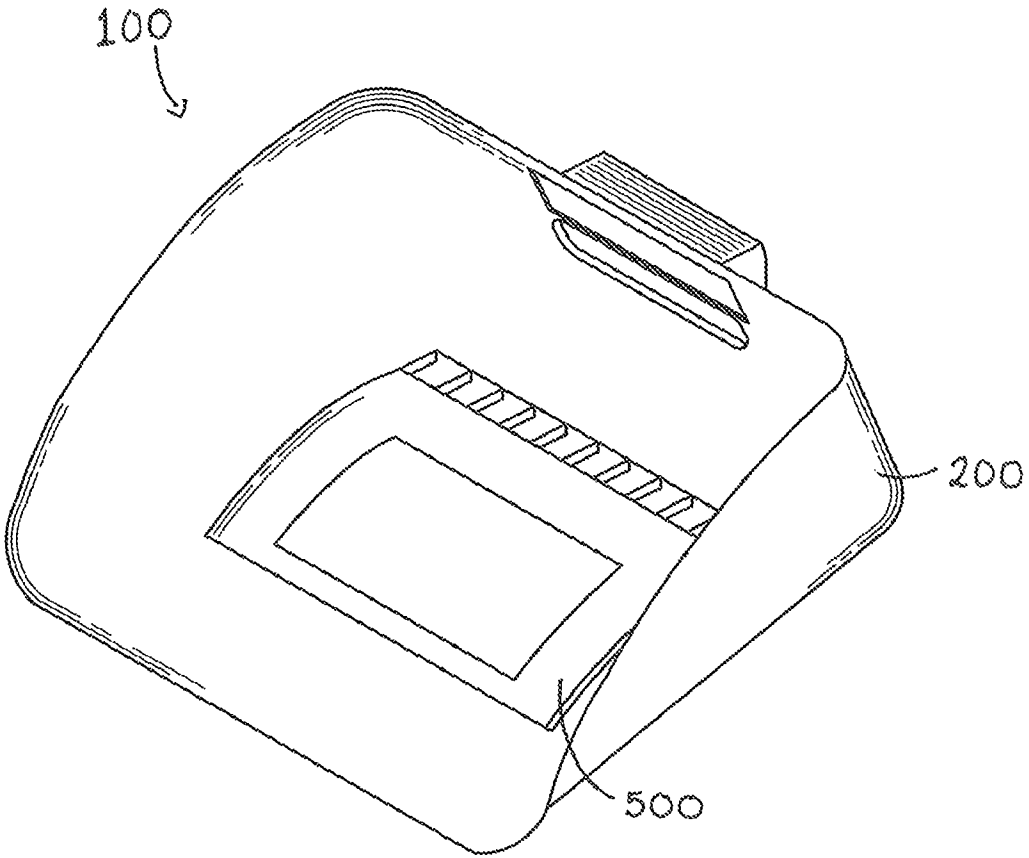
FIG. 1 illustrates a preferred embodiment of the scoop and gatherer set from an elevated perspective view wherein the gatherer is attached to the scoop.

As illustrated in FIG. 1, the scoop and gatherer set 100 comprises a scoop 200 and a gatherer 500, which both possess a rectangular like or trapezoid like shape. In a preferred embodiment, they are both trapezoid like in shape with the scoop mouth wider than the back wall, and the gatherer bottom edge wider than the top edge. As used herein, a "trapezoid" is defined as a plane figure with four sides, only two of which are parallel. And, a "rectangle" is defined as a plane figure with four sides and four right angles, wherein a "square" is a type of "rectangle".

Figure 2:
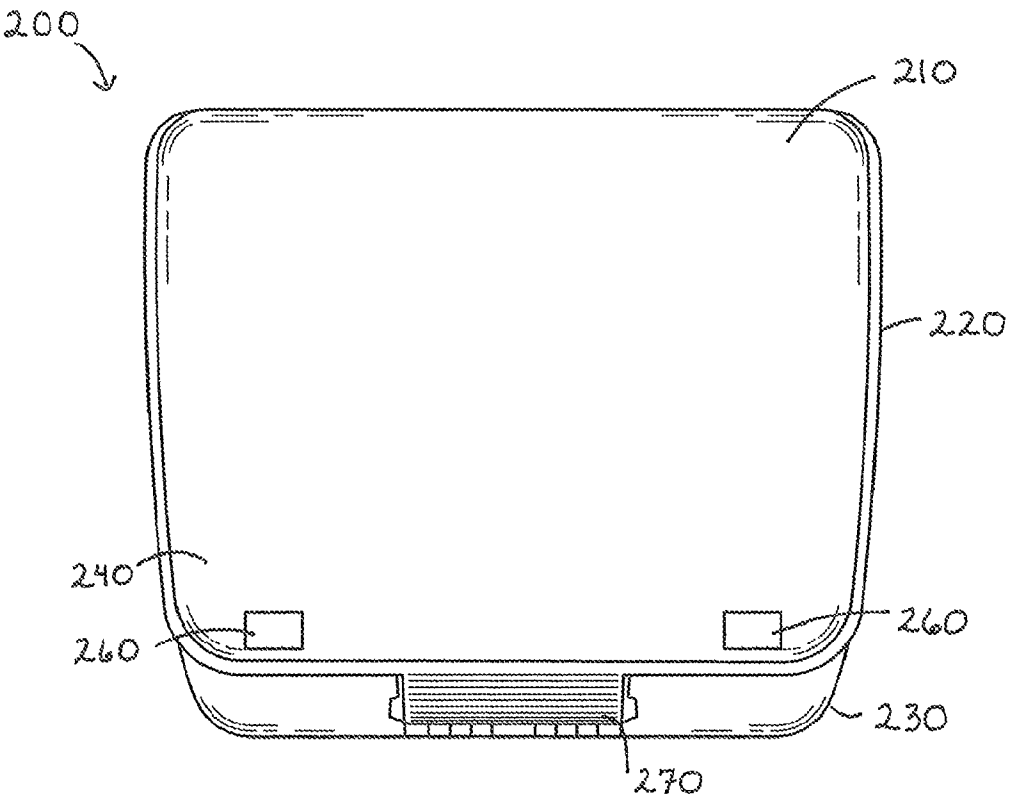
FIG. 2 is an overhead view of the scoop alone showing the bottom upper surface framed by the side and back walls, and providing an overhead view of the back wall ledge with a tactile surface.
Figure 6:
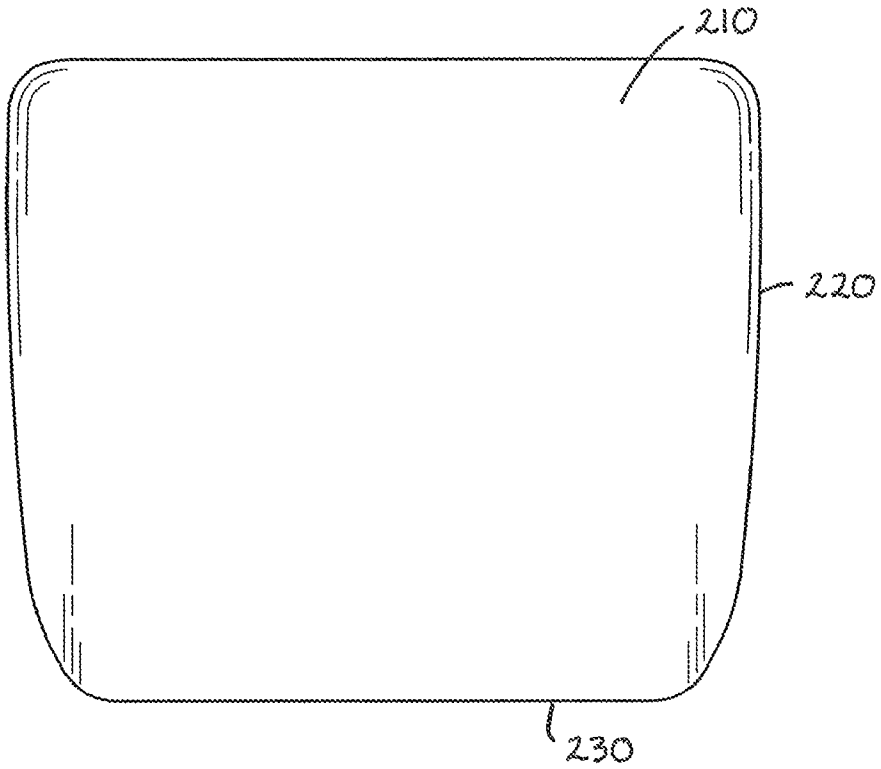
FIG. 6 is a bottom view of the scoop.

As shown in FIG. 2 and FIG. 6, the scoop 200 comprises a rectangular or trapezoid like bottom 210, two triangular like side walls 220, and a rectangular back wall 230. The front edge of the bottom is tilted down to create a ramp effect in assisting the pushing and/or sweeping of objects into the scoop (see FIG. 3, 320). The sides of the bottom that adjoin to the two side walls and to the back wall are curved and seamless so to prevent the collection of dirt and debris in cracks (see FIG. 2, 240).

Figure 8:
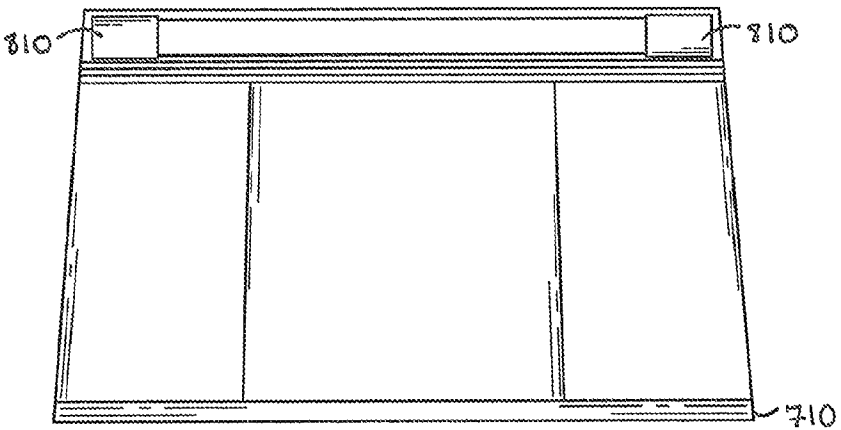
FIG. 8 is a back view of the gatherer's underside.

As further shown in FIG. 2, the bottom 210 further comprises a means to attach the gatherer to the upper surface of said bottom for storage of the two as one unit. In a preferred embodiment, the means comprise two strips of hook and loop fasteners (e.g. Velcro®) that are in the shape rectangles about ¾ inch*½ inch. The hooks reside on the scoop bottom's upper surface as either one strip or as two smaller strips (FIG. 2, 260); and the loops reside on the gatherer top edge underside as either one strip or two smaller strips (FIG. 8, 810). Furthermore, the hook and/or loop fabric may reside within recesses in the scoop and/or gatherer surface. It is noted that other means of attaching the gatherer to the scoop for storage as one unit are readily known in the art.

Figure 3:
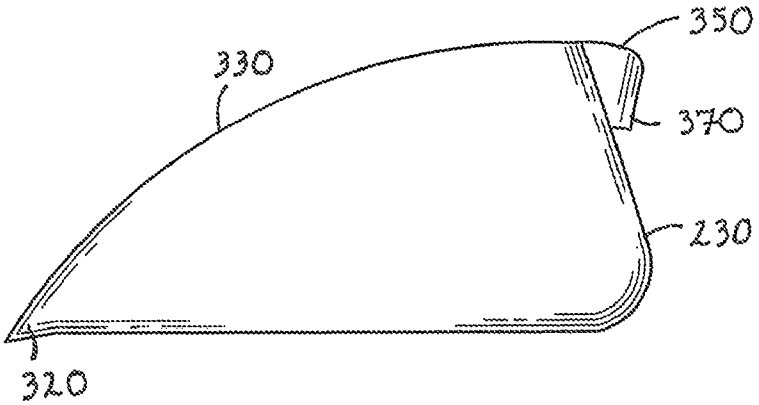
FIG. 3 is a side view of the scoop showing the triangular side walls with an arched top edge, the bottom's front edge angled downward, and the back wall's ledge for grasping the scoop.

As illustrated in FIG. 3, the side walls are primarily triangular like in shape, although in alternative embodiments of the present invention, the side walls may comprise other shapes, such as rectangular or trapezoidal. The side walls extend from the top of the back wall 230 to the bottom's front edge 320. In a preferred embodiment, the top edge 330 of the side walls is arch shaped. In line with the arch is the bottom's front edge 320 which is curved downward to assist in pushing and sweeping contents into the scoop. And in line with the arch is the back wall's ledge 350 that is used to grasp the scoop. The back wall resides at less than a 90 degree angle to the bottom to prevent the contents of the scoop from easily falling out when held.

Figure 4:
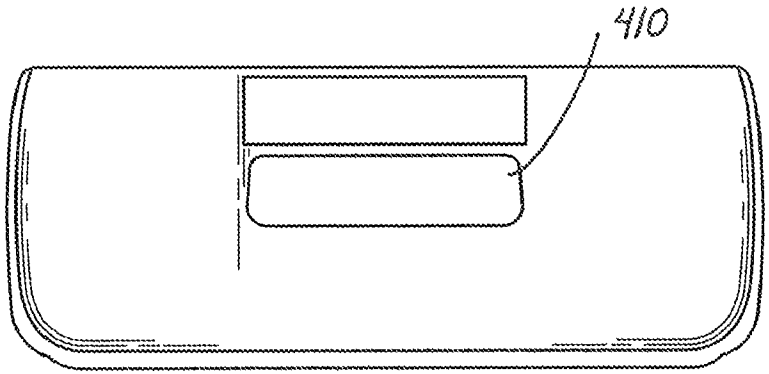
FIG. 4 is a front plan view of the scoop showing the hole for the user to insert their fingers to grasp the scoop.
Figure 5:
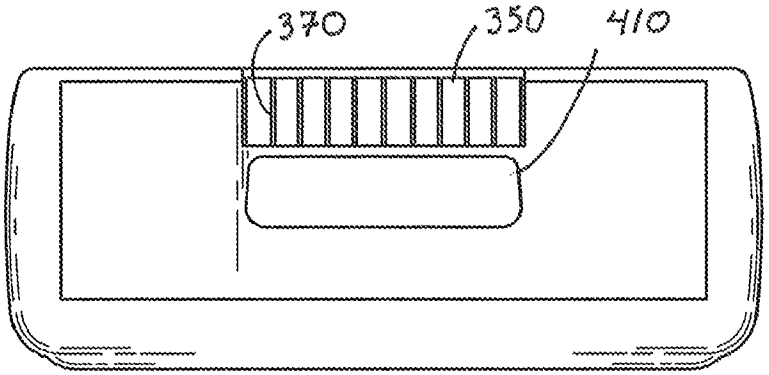
FIG. 5 is a black plan view of the scoop.

The present invention further comprises means for grasping the scoop without the use of a cylindrical handle. As demonstrated in FIG. 4 of the front view and in FIG. 5 of the back view, the scoop's back wall comprises a rectangular hole 410 of sufficient length to comfortably fit a user's index, long, ring, and small finger, and a ledge 350 extending horizontal from the top edge of the back wall about one inch, wherein a user places their fingers with their palm facing upwards and perpendicular to the floor into the hole and their thumb onto or over the top of the ledge. In this manner the weight of the scoop is primarily supported by the fingers while requiring minimal wrist rotation. The length and width of the hole may be a function of the intended user of the device. By way of exemplification, the hole in the device of the present invention for all sizes is about 3.5 inches long and about 1 inch wide The present invention may additionally comprise a tactile surface covering the ledge 350 to prevent a user's finger (e.g. thumb) from slipping. In a preferred embodiment, the surface comprises multiple raised lines or ridges as shown in FIG. 2, 270 that extend from and run parallel to the ledge top surface. The user may thus grasp the scoop in a variety of methods and points of contact. For example, the user may place their thumb on the ledge 350, or over the ledge 350 to the rest on inner surface of the back wall 230, and their index, long, ring, and small finger thru the hole 410 and onto the scoop's inner surface back wall 230. Or the user may place their thumb on the ledge 350, or over the ledge 350 to the rest on inner surface of the back wall 230, with their remaining fingers underneath the scoop's bottom surface 210.

Figure 7:
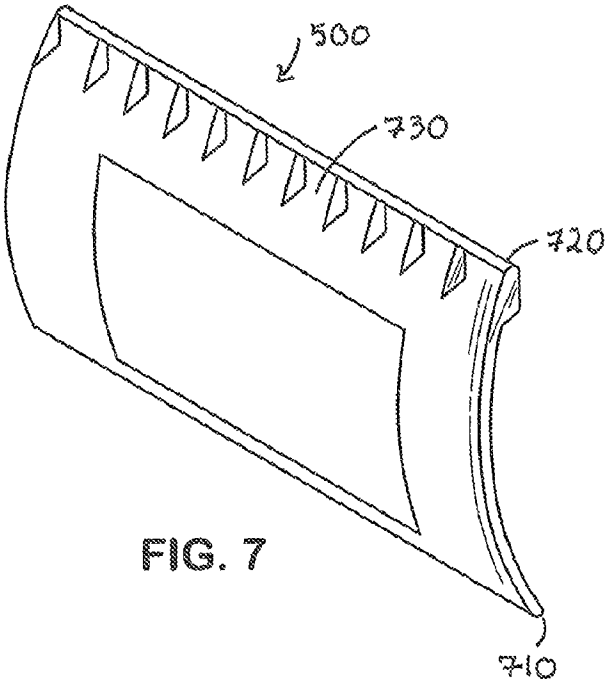
FIG. 7 is an elevated perspective view of the gatherer's upper side.
Figure 9:
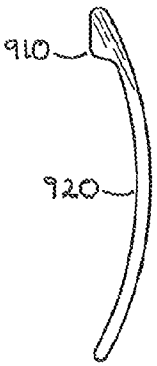
FIG. 9 is a side view of the concave gatherer showing a profile of the gather's ledge.
Figure 10:
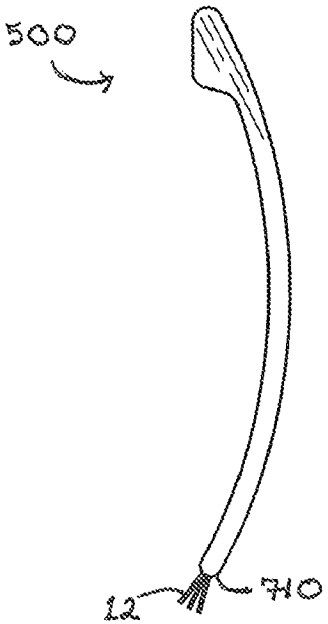
FIG. 10 is a side view of the gatherer with bristles attached to the bottom edge.
Figure 11:
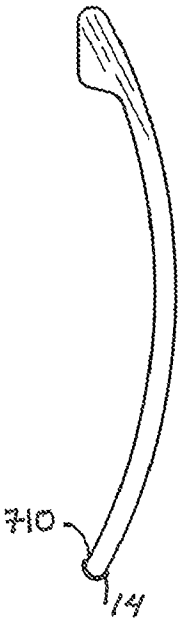
FIG. 11 is a side view of the gatherer with a soft material attached to the bottom edge to prevent scratching of floor surfaces.
Figure 12:
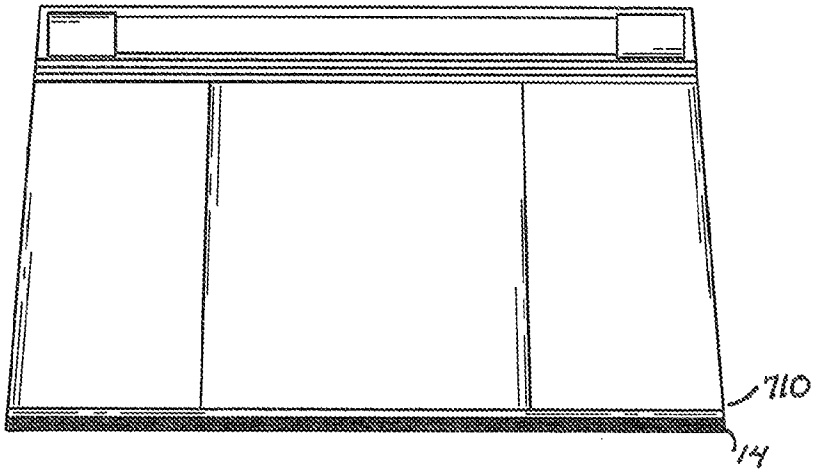
FIG. 12 is a back view of the gatherer's underside wherein a soft material is attached to the bottom edge of the gatherer.
Figure 13:
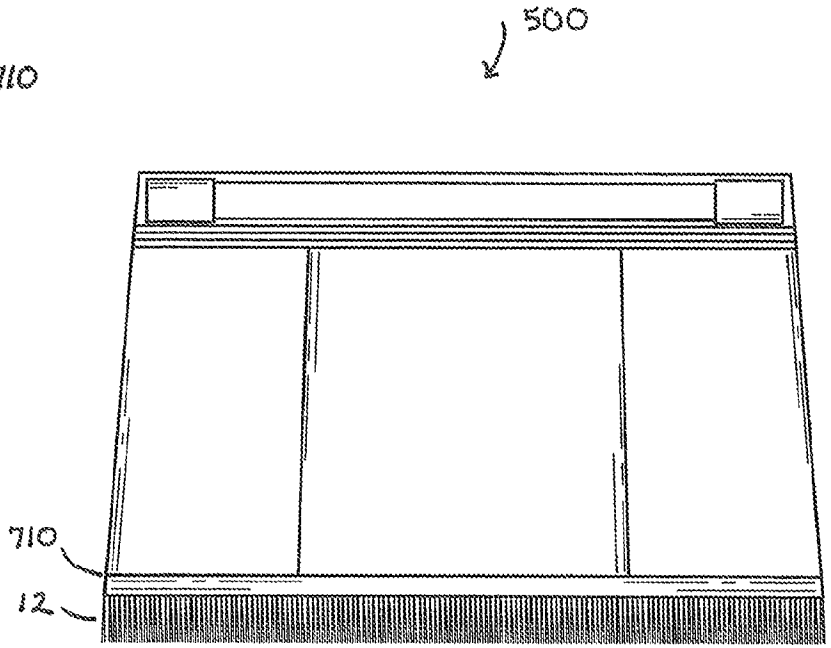
FIG. 13 is a back view of the gatherer's underside wherein bristles are attached to the bottom edge of the gatherer.

FIG. 7 is a front perspective view of the gatherer and in FIG. 8 in a back view of the gatherer, which primarily comprises a rectangular or trapezoid shaped apparatus small enough to be stored within the scoop. The gatherer comprises a bottom edge 710 engaged in pushing or placing objects or debris into the scoop, and wherein the bottom edge may also be lined with soft fabric, such as felt, to prevent scraping of a floor surface. The top edge 720 is held by the user and may further comprise vertical indentations 730 along the upper side of the top edge to reduce the weight of the gatherer. The gatherer may also comprise a ledge on the underside of the top edge as shown in FIG. 9, 910 to assist in grasping the device. The gatherer may also be slightly concave on the underside to assist in pushing or lifting and placing objects into the scoop (See FIG. 9, 920). When not in use, the gatherer may be stored within the scoop by attaching the gatherer underside to the scoop's bottom upper surface as stated supra.

In alternative embodiments of the gatherer 500, as shown in FIGS. 10-13, the bottom edge of the gatherer 710 may comprise additional fixtures for specific users of the present invention. For example, bristles 12 may extend from the gatherer bottom edge, wherein the gatherer would be used to sweep small items and debris into the scoop (See FIGS. 10 & 13). The bottom edge may alternatively be covered with a smooth surfaced durable material 14, such as felt or felt-like material, to prevent the gatherer's bottom edge from scratching a floor surface while in use (See FIGS. 11 & 12).

The scoop and gatherer set of the present invention may be made from a variety of materials and methods readily known to the skilled artisan, such as plastic injection molding with plastics made of homo-polymers or copolymer. In preferred embodiment, the method of manufacturing comprises injecting hot thermoplastic resin, such as Generic Prime Polypropylene Homopolymer material 574550 PP HP 2412 NAT HIVAL, or Acrylonitrile Butadiene Styrene (ABS). The resin is injected into a closed mold for the gatherer and scoop to create both the cavities and core features of the present invention.

Although the invention has been described with reference to specific embodiments thereof, this description is not meant to be construed in a limiting sense. Various modifications of the disclosed embodiments, as well as alternate embodiments of the invention will become apparent to persons skilled in the art upon reference to the description of the invention. It is therefore contemplated that such modifications can be made without departing from the spirit or scope of the present invention as defined.

What is claimed is:

1. A device for picking up small items and debris comprising:

a) a scoop comprising a bottom, two side walls, and a back wall, and wherein said back wall comprises a hole of sufficient size to insert a user's palm to grasp said scoop; and, b) a gatherer comprising an apparatus able to fit within said scoop, and able to push said items and debris into said scoop;

c) wherein said device does not comprise a cylindrical handle;

d) wherein said hole is enclosed by the back wall; and e) wherein the back wall of said scoop comprises a ledge extending from the back wall above said hole, said ledge having a top surface that is flush with a top edge of the back wall.

2. The device of claim 1, wherein said scoop's side walls are triangular and comprise an arched top edge.

3. The device of claim 2, further comprising the front edge of said bottom angled slightly downward to assist sweeping or pushing said items and debris into said scoop.

4. The device of claim 1, wherein said bottom and back wall are rectangular or trapezoidal in shape.

5. The device of claim 1, wherein said bottom is adjoined to said side and back walls via curved, seamless joints.

6. The device of claim 1, wherein said gatherer further comprises a rectangular or trapezoid shape, and is concave for lifting items and debris into said scoop.

7. The device of claim 6, wherein said gatherer may further comprise bristles of about 0.5 to about 1 inch in length extending from the bottom edge.

8. The device of claim 6, wherein said gatherer may further comprise a strip of smooth fabric along the bottom edge to prevent scraping of floor surfaces.

9. The device of claim 1, further comprising a means for said gatherer to be attachable to a surface within said scoop for storage of said device.

10. The device of claim 1, wherein said ledge has a width of about one inch, and wherein said ledge surface comprises a tactile material to prevent slippage of user's thumb.

11. The device of claim 1, wherein said items are toys and said user is a child.

12. The device of claim 1, wherein said items are nuts and bolts and said user is a carpenter.

13. A method of picking up small items and debris, comprising:

a) detaching said gatherer from said scoop in the device of claim 1;

b) lifting said scoop in a user's one hand;

c) clasping said gatherer in said user's second hand;

d) placing said scoop bottom outer surface in contact with a flat surface;

e) pushing and lifting said items and debris from said flat surface with said gatherer into said scoop;

f) dumping said items and debris into a storage compartment;

g) reattaching said gatherer to said scoop's bottom; and, h) storing said device as one unit set.

14. The method of claim 13, wherein lifting said scoop does not comprise extensive rotation of the user's wrist of the one hand.

15. The method of claim 13, wherein lifting comprises inserting a user's index, long, ring, and small finger through a hole within the back wall and onto the scoop's back wall inner surface, and pressing a user's thumb onto or over the back wall's ledge.

16. The method of claim 13, wherein lifting comprises pressing a user's index, long, ring, and small finger onto the underside of scoop's bottom, and pressing a user's thumb onto or over the back wall's ledge.

17. The method of claim 13, wherein said gatherer comprises bristles of about 0.5 to about 1 inch in length extending from the bottom edge, and said method further comprises brushing said items and debris into said scoop.

18. The method of claim 13, wherein said gatherer comprises a smooth fabric attached to the bottom edge, and said method further comprises pushing said items and debris into said scoop without scratching the floor surface.

19. The method of claim 13, wherein said user is a child and said items are toys.

20. The method of claim 13, wherein said attaching and detaching of said gatherer from said scoop comprises the use of hook and loop fasteners.

* * * * *